US005954230A

United States Patent [19]

Blette et al.

[11] Patent Number: 5,954,230

[45] Date of Patent: Sep. 21, 1999

[54] DEVICE AND METHOD FOR MIXING AND DISPENSING MULTIPART SOLUTIONS

[75] Inventors: Russell E. Blette, Hastings; Brian A. Kubicek, Woodbury, both of Minn.

[73] Assignee: 3M Innovative Properties Company, St. Paul, Minn.

[21] Appl. No.: 08/987,174

[22] Filed: Dec. 8, 1997

[51] Int. Cl.[6] ..... B65D 35/22; B65D 25/08; B65D 30/22

[52] U.S. Cl. ..... 222/1; 222/95; 222/94; 222/136; 222/129; 206/219; 383/38; 383/39

[58] Field of Search ..... 222/94, 95, 136, 222/129; 206/219, 221; 383/38, 39, 906

[56] References Cited

U.S. PATENT DOCUMENTS

| | | | |
|---|---|---|---|
| 2,932,385 | 4/1960 | Bollmeier et al. | 206/47 |
| 3,294,227 | 12/1966 | Schneider et al. | 206/47 |
| 3,339,716 | 9/1967 | Taylor | 206/47 |
| 3,805,991 | 4/1974 | Cheladze et al. | 220/44 R |
| 4,168,788 | 9/1979 | Quinn | 222/482 |
| 4,265,372 | 5/1981 | Wainberg | 222/94 |
| 4,534,509 | 8/1985 | Holzner | 239/34 |
| 4,732,299 | 3/1988 | Hoyt | 222/94 |
| 4,971,251 | 11/1990 | Dobrick et al. | 239/346 |
| 5,176,634 | 1/1993 | Smith et al. | 604/87 |
| 5,257,986 | 11/1993 | Herbert et al. | 604/416 |
| 5,287,961 | 2/1994 | Herran | 206/219 |
| 5,337,921 | 8/1994 | Wilson et al. | 222/105 |
| 5,338,475 | 8/1994 | Corey et al. | 252/102 |
| 5,373,966 | 12/1994 | O'Reilly et al. | 222/94 |
| 5,577,369 | 11/1996 | Becker et al. | 53/474 |
| 5,728,669 | 3/1998 | Tyerech | 510/280 |

FOREIGN PATENT DOCUMENTS

| | | | |
|---|---|---|---|
| 0 345 774 | 12/1989 | European Pat. Off. | B65D 81/32 |
| 2 134 067 | 8/1984 | United Kingdom | B65D 81/32 |

*Primary Examiner*—Andres Kashnikow
*Assistant Examiner*—Keats Quinalty
*Attorney, Agent, or Firm*—Daniel C. Schulte

[57] ABSTRACT

A device for mixing and dispensing a multipart solution is descried. The device includes a flexible pouch having a first compartment and a second compartment. The first compartment and the second compartment are divided by a barrier that is at least partially breakable. The first compartment can contain a first solution and the second can contain a second solution, such that breaking the breakable barrier results in the mixing and the first and second solutions to form a multipart solution. The flexible pouch contains a dispenser to provide access to the solution within the flexible pouch. A system and method for mixing and dispensing a multipart cleaning solution are also described.

14 Claims, 3 Drawing Sheets

DEVICE AND METHOD FOR MIXING AND DISPENSING MULTIPART SOLUTIONS

FIELD

This invention relates to a device and system for mixing and dispensing multipart solutions that is useful for mixing and dispensing multipart cleaning solutions.

BACKGROUND

Multipart solutions, i.e., solutions mixed from separate solution components immediately prior to use, are known. Such systems typically involve mixing volumes of separate solution components from separate containers to form the solution, followed by immediate use of the resultant solution. Mixing of the separate solution components may result in the reaction of the components with each other, including activation of one of the components by one or more of the other components, catalysis by one of the solution components, or the like. It is often desirable to maintain the solution components separate from one another until just prior to use to prevent premature reaction or degradation of the components. One example of such a multipart solution is a two-part cleaning solution in which one solution component contains an oxidizing agent and a second solution component contains a wetting agent and a pH adjusting agent.

The use of multipart solutions generally requires the user to measure and mix the components together just prior to use, which can be cumbersome and risks contacting the solutions with the user, which can be harmful if the solution components are toxic or hazardous. In addition, repeated opening of bottles containing separate components of a multipart solution can cause contamination and degradation of the components, such that the performance of the component in a solution is compromised. It is also generally important, in preparing a multipart solution, that the components be mixed in precise volume ratios (e.g., 1:1 mixture of a two-part solution). If too much or too little of a component is used, the solution may not perform optimally or at all, or the improperly mixed solution could damage its substrate.

SUMMARY OF THE INVENTION

In one aspect, the invention features a device for mixing and dispensing a multipart solution. The device includes a flexible pouch having first and second compartments. The first compartment is adjacent to the second compartment, and the first compartment is divided from the second compartment by a barrier that is at least partially breakable. The first and second compartments are adapted to contain, respectively, first and second solutions that are components of a multipart solution. Upon breaking of the breakable barrier, the first and second solutions can be mixed to form a desired multipart solution. The flexible pouch includes a dispenser, such as a threaded fitment in the form of a spout sealed into the pouch, in combination with a cap, a vented cap, and/or a spray pump or atomizer, to provide access to the mixed solution within the pouch. The device is useful for mixing and dispensing multipart aqueous or low viscosity solutions, such as aqueous cleaning solutions.

In another aspect, the invention features a system for mixing and dispensing a multipart solution. As with the device of the invention, the system includes a flexible pouch having first and second compartments; the first compartment is adjacent to the second compartment, and the first compartment is divided from the second compartment by a barrier that is at least partially breakable. The first and second compartments contain, respectively, first and second solutions that are components of a multipart solution. The flexible pouch includes a dispenser to provide access to the multipart solution within the pouch.

In preferred embodiments, the system is adapted for mixing and dispensing a multipart cleaning solution. In these embodiments, one of the compartments preferably contains an oxidizing agent, such as a peroxide, such that mixing of the oxidizing agent with the solution in the other compartment results in the formation of an oxidizing cleaning solution. In a particularly preferred embodiment, one of the first and second compartments contains between about 5 to about 30 percent by weight hydrogen peroxide and the remainder water, and the other compartment contains up to 60% by weight of a wetting agent, and optionally a pH adjusting substance, for example between about 0.1 percent and 5 percent by weight ammonium hydroxide, and the remainder water. The latter compartment preferably contains a sufficient amount of pH adjusting substance such that the final pH of the mixed multipart solution is between about 9.0 and about 10.5. The cleaning solution that results from mixing these components is particularly useful in cleaning carpet and upholstery fibers.

The invention also features a method for mixing and dispensing a multipart solution. The method involves the steps of providing a system as described above, applying pressure to the flexible pouch sufficient to disrupt the breakable barrier, mixing the first solution and second solution such that the first and second solutions form a multipart solution, and dispensing the multipart solution with the dispenser. Preferably, the method relates to mixing and dispensing a multipart cleaning solution.

As described herein, the present invention has several advantages. The compartments of the flexible pouch can be adapted to contain premeasured and specific volumes, such that when the solutions in the compartments are mixed, precise volumes of the components are mixed together to form a desired solution. This feature avoids the possibility of an improperly measured solution that would not perform as well as a correctly calibrated solution or that would damage its intended substrate. It also eliminates the need for the user to have any contact with the components of the solution in mixing the components prior to use. The present invention eliminates the need to repeatedly open bottles of solution components (which can cause degradation of the components over repeated exposure to air) in order to prepare a multipart solution. The system of the invention can be adapted for single use; the compartments of the flexible pouch can contain premeasured volumes such that the multipart solution is of a sufficient volume for a typical single use, and the pouch can be disposed of after the single use. The system is thus very convenient to use, and does not require the cumbersome (and often inaccurate) task of using separate bottles of the solution components to measure and mix the solution.

Other advantages of the invention will be apparent from the following description and drawings, and from the appended claims.

DESCRIPTION OF THE PREFERRED EMBODIMENTS

Figure 1:
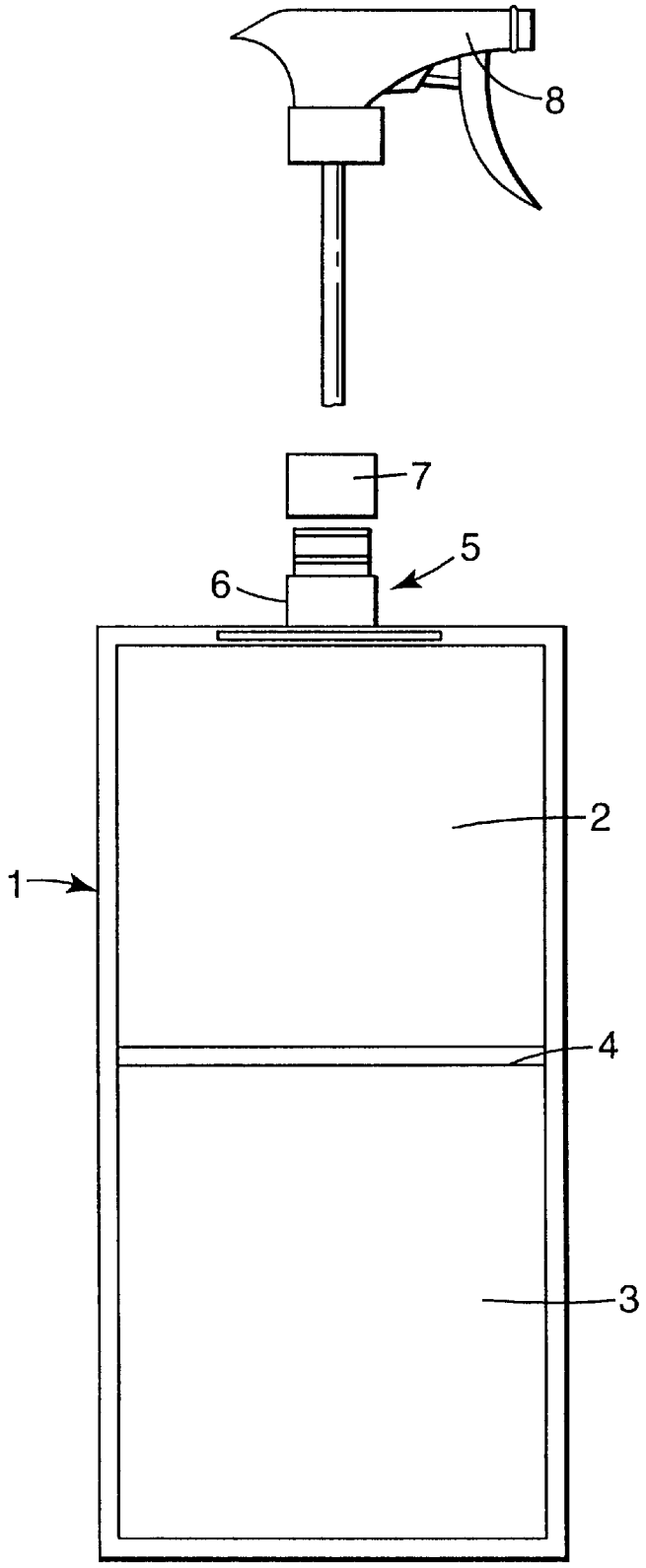
FIG. 1 shows a device for mixing and dispensing a cleaning solution in accordance with one embodiment of the present invention.

FIG. 1 shows one embodiment of a device for mixing and dispensing a multipart solution in accordance with the present invention. In the device, a flexible pouch 1 has a first compartment 2 and a second compartment 3. The first and second compartments are divided such that they do not communicate with each other, and are at least partially divided by breakable barrier 4 (shown in cross-section in FIG. 2). The first compartment 2 is adapted to contain a first solution and the second compartment 3 is adapted to contain a second solution. The breaking of the breakable barrier (for example by rolling the pouch from the second compartment 3 toward the first compartment 2, and thereby exerting force on the breakable barrier) results in the mixing of the first and second solutions to form a solution within the flexible pouch. The flexible pouch 1 contains a dispenser 5 that provides access to the contents of the flexible pouch.

In a preferred embodiment, and as shown in FIG. 1, the dispenser 5 of the flexible pouch 1 may be in the form of a fitment 6, which may be sealed into the periphery of the flexible pouch 1. The fitment 6 may be in the form of a spout adapted to receive a cap 7, as shown in FIG. 1. In preferred embodiments, the cap is vented to permit the venting of vapor (e.g. produced by a solution in the first compartment) but not liquid. Such caps are well known in the art. A spray pump or atomizer 8, also well known in the art, may be provided to facilitate dispensing of the solution.

The device of the present invention is useful in the packaging, mixing, and dispensing of any multipart solution for which it is desired to maintain the individual solution components separately before mixing them just prior to use. The device is particularly useful for mixing and dispensing aqueous, low viscosity multipart solutions, including aqueous multipart cleaning solutions. Other multipart solutions for which the device is useful include multipart curable resin solutions, multipart adhesive compositions, multipart sealing compositions, multipart cleaning solutions, multipart enzymatic solutions, and the like. The device can be useful, for example, where it is desired to keep solution components separate until just prior to use, and where it is desired to accurately mix particular amounts of multipart solution components together.

The flexible pouch 1 of the device may be comprised of any suitable material. Flexible, heat sealable polymeric materials are preferred. For example, the flexible pouch of the device may include first and second sheets of a flexible polymeric material bonded or sealed together about their peripheries to form a pouch. Suitable materials for use in preparing a flexible pouch include polymeric sheets of laminated or non-laminated films that can be bonded or sealed together along aligned edges in a manner known in the art. In a preferred embodiment of the invention, a flexible pouch is constructed of a laminate of polyethylene terephthalate (PET), biaxially oriented nylon, and linear low density polyethylene available from Kapak Corporation of Minneapolis, Minn. The flexible pouch material may be darkened, e.g., by the inclusion of darkened layer in a laminate or the use of a darkened material as the flexible pouch itself, to protect material that is sensitive to light. An example of such a darkened material is PET with a rotogravure-black flood coat, which is commercially available. In a preferred embodiment, a laminate used to form the flexible pouch includes a layer of heat-activated adhesive, such as a hot melt adhesive of the type well known in the art, such that first and second polymeric sheets can be heat sealed about their peripheries to form a pouch. In these embodiments, a fitment, such as a molded plastic material in the form of a spout, can also be heat sealed into the flexible pouch to form a dispenser.

Figure 2:
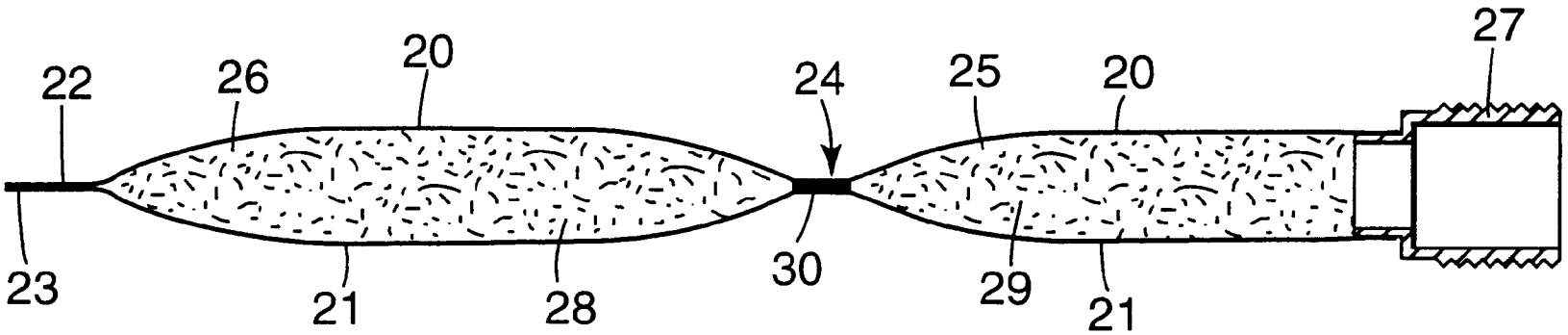
FIG. 2 shows a cross section of a device of the present invention.

FIG. 2 shows a cross section of a device in accordance with the invention. Flexible pouch sheets 20 and 21 are bonded about their peripheries 22 and 23 to form a flexible pouch. Breakable barrier 24 divides a first compartment 25 from second compartment 26, which contain, respectively, first and second solutions 28 and 29. The flexible pouch contains a dispenser 27. As shown in FIG. 2, the dispenser 27 is in the form of a threaded fitment in the form of a spout, with a portion sealed to the peripheries of flexible pouch sheets 20 and 21. When breakable barrier 24 is broken, the contents of compartments 25 and 26 can be mixed together to form a multipart solution. The dispenser may then be utilized to dispense the solution. The dispenser may be a fitment in the form of a spout, wherein the spout is adapted to receive a cap, as shown in FIG. 2. The dispenser may also be a combination of a fitment and spray pump or atomizer, as shown in FIG. 1.

The breakable barrier may be formed in a variety of ways. In one example, a thin porous paper coated on both surfaces with a polymeric material can be heat sealed between the inner surfaces of the flexible pouch material using materials and methods known in the art, thereby creating a barrier between first and second compartments that can be broken, for example, by rolling the flexible pouch or otherwise applying pressure to the pouch. Examples of breakable barrier constructions suitable for use in the device and system of this invention are described in U.S. Pat. No. 2,932,385, the disclosure of which is incorporated herein by reference. The strength of the breakable barrier is preferably sufficient to allow handling of the pouch in manufacturing, shipping and storage of the device without breaking the barrier, but preferably can be broken at pressures of about 3 lb., and in any event, at pressures below those required to break any peripheral bond in the flexible pouch. Other examples of breakable barriers that would be suitable for use in the device include barriers made by sealing a fabric, such as a non-woven or woven fabric, to the inner surfaces of the flexible pouch material or barriers formed by using an adhesive to bond the inner surfaces of the flexible pouch together. The construction of these breakable barriers, and the ability to alter their strength to suit a particular application, are within the skill of those practicing in the art. At least part of the barrier that divides the compartments of the flexible pouch must be a breakable barrier as described herein; a portion of the barrier dividing the compartment of the flexible pouch may be unbreakable at the pressures described above. Preferably, the entirety of the barrier dividing the compartments is breakable. In FIG. 2, breakable barrier 24 includes a porous paper 30, which is bonded to the inner surface of a flexible pouch formed by sheets 20 and 21. Preferably, the sheets used to form the flexible pouch include a heat-activated adhesive such that the material used to form the breakable barrier may be heat sealed to the pouch material.

The device of the invention may also include a third compartment, such that the third compartment is divided from the second compartment at least partially by a breakable barrier. This device would be useful in mixing and dispensing a three-part solution in which the components of the solution are kept separated before use.

The device may be made using a number of methods known in the art. In one embodiment, the flexible pouch is made from a flexible polymeric material constructed of a laminate of polyethylene terephthalate (PET), biaxially oriented nylon (BON), linear low density polyethylene (LLOPE) available from Kapak Corp. (Minneapolis, Minn.). The flexible pouch is laminated peripherally together, e.g., by heat lamination, along the edges of the polymeric sheets. A dispenser, e.g. fitment in the form of a spout, may be bonded at one end of the pouch during this step. A breakable barrier material may be bonded along the center. The bottom compartment (the compartment not containing the fitment) is left open for filling with one of the solution components, and sealed after filling. The compartment to which the fitment is attached may be filled through the spout with another solution component and then the spout may be sealed with a cap. The cap may then be sealed with a shrinkable tape. If a solution component to be filled into the device generates vapor, it is preferable to fill the vapor-generating component into the compartment that is in communication with the dispenser, and a vented cap that allows venting of vapor but not liquid is preferably used to cap the dispenser.

As discussed above, the device of the invention is particularly useful as part of a system for mixing and dispensing a multipart solution. Accordingly, the invention features such a system. The system includes a device generally as described above, wherein the first compartment contains a first solution and the second compartment contains a second solution, and wherein the first and second solutions are parts of a multipart solution.

In a preferred embodiment, the system is adapted for mixing and dispensing a multipart cleaning solution. In this embodiment, one of the first and second solutions preferably contains an oxidizing agent, such as a peroxyhydrate (hydrogen peroxide or a compound which, in an aqueous solution, yields hydrogen peroxide), and the other solution contains a wetting agent and, optionally, a pH adjusting substance. In one preferred embodiment of the system, the first solution contains between about 5 percent and about 30 percent by weight hydrogen peroxide as an oxidizing agent, and the second contains a wetting agent and, optionally, a pH adjusting substance. The parts of the multipart cleaning solution can be mixed by disruption of the breakable barrier, and the contents of the flexible pouch can be accessed and dispensed by a dispenser as described above, or simply by accessing the multipart cleaning solution by opening an openable portion of the flexible pouch, such as a perforation along or near the periphery of the flexible pouch.

Suitable multipart cleaning solutions that employ an oxidizing agent in one part and a wetting agent in a second part are described in U.S. Pat. Nos. 5,389,278, 5,348,556, and 5,252,243, the disclosures of which are incorporated herein by reference. Any of the multipart cleaning solutions described in these patents is suitable for use in the device or system of the present invention. In general, the multipart cleaning solutions are mixtures of ingredients such that the solution applied to a substrate has between about 3% and about 15% of a peroxide. Preferably, the multipart solution contains up to 30% of a wetting agent. Optionally, the solution may contain a pH adjusting substance, such as, for example, between about 0.1 percent and about 5 percent by weight ammonium hydroxide. In preferred embodiments, there is a sufficient amount of pH adjusting substance such that the final pH of the mixed multipart cleaning solution is between about 9 and about 10.5. These multipart cleaning solutions are useful in the treatment of stains on carpet or upholstery fibers, including stains from soil, food, pets, organic materials, and the like.

A wide variety of wetting agents are suitable in the multipart cleaning composition. Generally, preferable wetting agents are miscible with water and organically based. Two classes of useful wetting agents or glycols and lower aliphatic alcohols. Exemplary alcohols include water-soluble alcohols containing up to 5 carbon atoms, such a methyl alcohol, ethyl alcohol, n-propyl alcohol, isopropyl alcohol, sec-butyl alcohol, tert-butyl alcohol. The presently preferred alcohol is isopropyl alcohol. Exemplary glycols include glycerol, ethylene glycol, and propylene glycol.

Oxidizing agents that find particular application in the multipart cleaning solution include peroxyhydrates. The term "peroxyhydrate", as used herein, means hydrogen peroxide or any compound which, in an (aqueous) composition, yields hydrogen peroxide. Examples of such compounds include alkali metal peroxides, such as sodium peroxide and potassium peroxide, sodium perborate monohydrate and tetrahydrate, sodium persulfate, sodium percarbonate, sodium peroxydihydrate, various phosphate peroxyhydrates, such as sodium or potassium peroxydiphosphate, potassium carbonate peroxydihydrate, and organic peroxyhydrates such as urea peroxide. The presently preferred oxidizing agent is hydrogen peroxide.

The amount of oxidizing agent and wetting agent utilized in the multipart cleaning solution may vary over a wide range. The amount of oxidizing agent employed is generally an amount in the range of from about 3 to about 15 percent by weight of multipart solution and, preferably, about 10 percent by weight of solution. The amount of wetting agent is preferably present up to about 30 percent by weight of solution and, more preferably, about 1 to about 5 weight percent based on the weight of the solution.

In the practice of the invention, it is desirable that the pH of the multipart cleaning solution be in the range of from about 9.0 to about 10.5. The pH can be adjusted using acidic or alkaline compounds well known in the art. Exemplary compounds for adjusting the pH of the solution include sodium hydroxide, potassium hydroxide, ammonium hydroxide, sodium carbonate, trisodium phosphate and tetrasodium pyrophosphate. Other pH adjusting substances useful with the present invention will be apparent to those ordinarily skilled in the art.

The presently preferred multipart cleaning solution has a pH of between about 9.0 and about 10.5, and comprises hydrogen peroxide present about 10 percent by weight of aqueous composition and isopropyl alcohol present at about 1 to 5 percent by weight of aqueous composition. Deionized water is preferably the remaining ingredient. In a system for mixing and dispensing such a multipart cleaning solution, first and second compartments of a system as described above may contain equal volumes of first and second solutions, respectively. The first compartment may contain 20 percent by weight hydrogen peroxide with the remainder water, and the second compartment may contain from 2 to 10 percent isopropyl alcohol, ammonium hydroxide in sufficient amount such that the final pH of the multipart solution is between about 9.0 and 10.5 (preferably about 10), and the remainder water. The compartments may be mixed together to form the desired solution.

To use a system of this invention to mix and dispense a multipart cleaning solution, the breakable barrier in the flexible pouch is first broken. This may be accomplished by rolling the pouch from one end to apply force at the breakable barrier sufficient to disrupt the barrier. See FIG.

Figure 3A:
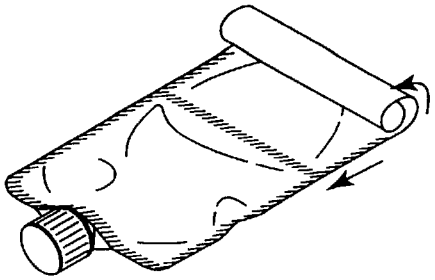
FIGS. 3A–3C illustrate the use of a device of the present invention in a system for mixing and dispensing a multipart solution.
Figure 3B:
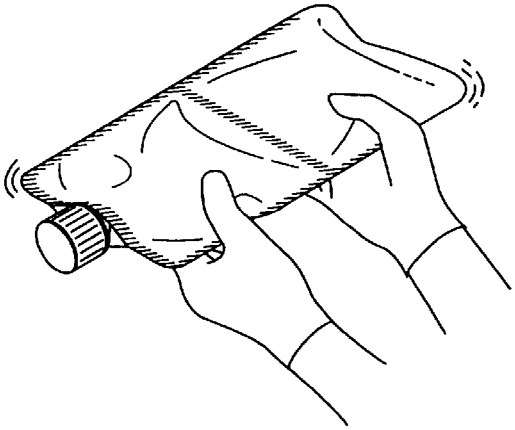
Figure 3C:
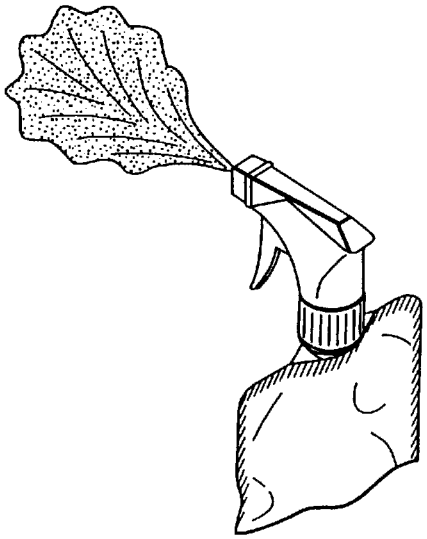

3A. After the breakable barrier is disrupted, the pouch may be manipulated to mix the contents of the compartments that were separated by the breakable barrier. See FIG. 3B. Once mixing is complete, the openable portion of the flexible pouch can be opened (e.g. by removing a vented cap from a spout in a fitment) and the multipart cleaning solution dispensed (e.g. poured or squeezed out of the opening or sprayed from a spray pump attached to a spout) onto a stained substrate (e.g., carpet or upholstery fibers) to remove or treat a stain. See FIG. 3C. The stained substance or area to which the multipart cleaning solution is applied may be pre-treated by pre-wetting with water. After application of the multipart cleaning solution to the treatment area, a vapor barrier material, such as a PAT-IT™ sheet (available from 3M) may be placed over the treatment area to contain the chemical reaction. The vapor barrier material is preferably a non-breathable material that traps oxygen generated from the chemical reaction and prevents it from dissipating from the treatment area, thereby prolonging the treatment process. After a sufficient amount of time is allowed for the multipart cleaning solution to perform, the treated area can optionally be rinsed with water to remove the cleaning solution.

Other embodiments of the invention are within the scope of the appended claims.

What is claimed is:

1. A method for dispensing a multipart solution onto a substrate, said method comprising:

providing a first solution comprising an oxidizing agent;

providing a second solution comprising a wetting agent and optionally a pH adjusting substance;

providing a device comprising a first compartment and a second compartment, said first compartment adjacent to said second compartment and divided from said second compartment by an at least partially breakable barrier, said first compartment containing said first solution and said second compartment containing said second solution, such that breaking of said breakable barrier results in the mixing of said first and said second solutions to form a multipart solution, and said flexible pouch having an openable portion to provide access to said multipart solution within said flexible pouch;

applying pressure to said flexible pouch sufficient to disrupt said breakable barrier;

mixing said first solution and said second solution such that said first and second solutions mix to form a multipart solution;

opening said openable portion of said flexible pouch and attaching a spray pump to said openable portion; and spraying said multipart solution through said spray pump attached to said openable portion, onto a substrate.

2. The method of claim 1, wherein providing pressure to said flexible pouch comprises rolling said pouch.

3. The method of claim 1, wherein said first solution comprises between about 5 percent and 30 percent by weight hydrogen peroxide.

4. The method of claim 1, wherein said second solution comprises between about 0.1 percent and 5 percent by weight ammonium hydroxide and less than about 60 percent by weight isopropyl alcohol, said second solution comprising a sufficient amount of said ammonium hydroxide such that the pH of the multipart solution is between about 9.0 and about 10.5.

5. The method of claim 4, wherein said dispensing comprises dispensing said multipart solution onto carpet fibers.

6. The method of claim 5, further comprising the step of placing a vapor barrier material over said carpet fibers.

7. The method of claim 1 wherein said oxidizing agent comprises a peroxide.

8. The method of claim 7 wherein said peroxide comprises hydrogen peroxide.

9. The method of claim 1 wherein said pH adjusting substance comprises between about 0.1 percent and about 5 percent by weight ammonium hydroxide, and wherein said second solution comprises a sufficient amount of said pH adjusting substance such that the multipart solution has a pH of between about 9.0 and about 10.5.

10. The method of claim 1 wherein said wetting agent is chosen from the group consisting of a glycol, an aliphatic alcohol, and mixtures thereof.

11. The method of claim 10 wherein said wetting agent is chosen from the group consisting of methyl alcohol, ethyl alcohol, n-propyl alcohol, isopropyl alcohol, sec-butyl alcohol, tert-butyl alcohol, and mixtures thereof.

12. The method of claim 1 wherein said substrate comprises a fibrous substrate.

13. The method of claim 1 wherein said substrate comprises carpet fiber.

14. The method of claim 1 wherein said substrate comprises upholstery.

* * * * *